US007380381B2

(12) United States Patent
Honda

(10) Patent No.: US 7,380,381 B2
(45) Date of Patent: Jun. 3, 2008

(54) MODESTY PANEL AND EXTERNAL WALL CONSTRUCTION STRUCTURE USING SAID MODESTY PANEL

(75) Inventor: Takashi Honda, Anjo (JP)

(73) Assignee: Nichiha Co., Ltd., Nagoya-shi (JP)

( * ) Notice: Subject to any disclaimer, the term of this patent is extended or adjusted under 35 U.S.C. 154(b) by 0 days.

(21) Appl. No.: 11/409,264

(22) Filed: Apr. 24, 2006

(65) Prior Publication Data

US 2006/0272255 A1 Dec. 7, 2006

(30) Foreign Application Priority Data

Apr. 26, 2005 (JP) ..... 2005-127358

(51) Int. Cl.

| | |
|---|---|
| ***E04C 3/00*** | (2006.01) |
| ***E04C 2/38*** | (2006.01) |
| ***E04F 19/04*** | (2006.01) |
| ***E04B 2/00*** | (2006.01) |

(52) U.S. Cl. ..... 52/461; 52/290; 52/718.06; 52/474

(58) Field of Classification Search ..... 52/290, 52/393, 395, 396.04, 396.06, 402, 459–461, 52/465–472, 716.1, 716.2, 718.01, 718.04, 52/718.05, 718.06, 731.2, 731.1, 474, 302.1, 52/58, 60

See application file for complete search history.

(56) References Cited

U.S. PATENT DOCUMENTS 3,341,999 A * 9/1967 Berg ..... 52/395
3,404,495 A * 10/1968 Simpson, Jr. ..... 52/58
6,276,101 B1 * 8/2001 Schiedegger et al. ..... 52/211
6,421,964 B1 * 7/2002 Schiedegger et al. ..... 52/94
2002/0032999 A1 * 3/2002 Ito ..... 52/474

FOREIGN PATENT DOCUMENTS

| | | | |
|---|---|---|---|
| JP | 09041652 A | * | 2/1997 |
| JP | 10-96319 | | 4/1998 |
| JP | 2001-271485 | | 10/2001 |
| JP | 2002-89008 | | 3/2002 |

* cited by examiner

*Primary Examiner*—Richard E. Chilcot, Jr.
*Assistant Examiner*—Elizabeth A Plummer
(74) *Attorney, Agent, or Firm*—Edwards Angell Palmer & Dodge LLP

(57) ABSTRACT

The present invention provides a modesty panel capable of being stably attached to a fixing surface of a building side regardless of the unevenness of the fixing surface, and an external wall construction structure in which the modesty panel is attached. In the external wall construction structure, a base member 10 provided with an upper attaching portion 12 and a lower attaching portion 13 is fixed to the building external wall surface 2. The base member 10 has first and second engaging stepped portions 16 and 17. To this base member 10, a modesty panel main body 30, provided with first and second engaging ridges 32 and 33, is outwardly engaged. In a superimposed region S formed by the engagement, a fixing screw 4 is screwed to integrally and firmly fix the modesty panel main body 30 and the base member 10.

10 Claims, 16 Drawing Sheets

-- Prior Art --

-- Prior Art --

-- Prior Art --

MODESTY PANEL AND EXTERNAL WALL CONSTRUCTION STRUCTURE USING SAID MODESTY PANEL

This application claims priority under 35 U.S.C. §119 to Japanese Patent Application No. 2005-127358 filed on Apr. 26, 2005, the entire disclosure of which is incorporated herein by reference in its entirety.

BACKGROUND OF THE INVENTION

1. Field of the Invention

The present invention relates to a modesty panel to be attached to a joint portion of upper and lower external wall panels on a building external wall mainly for an ornamental purpose, and also relates to an external wall construction structure using the modesty panel.

2. Description of the Related Art

The following description sets forth the inventor's knowledge of related art and problems therein and should not be construed as an admission of knowledge in the prior art.

Generally, an elongated panel to be horizontally attached is called a modesty panel. In an external wall construction structure in which external wall panels are attached to an external wall surface of a building side, a modesty panel is attached so as to extend in a horizontal direction at a portion where the external wall design changes, such as, e.g., a portion between a first floor portion and a second floor portion. Furthermore, in some cases, a modesty panel is attached to cover a joint portion between a lower end of an upper external wall panel and an upper end of a lower external wall panel formed when the external wall panels are attached.

FIG. 15 shows an example of a construction structure covering a joint portion of upper and lower external wall panels with a decorative modesty panel. In this example, a water draining member 8 is fixed between end portions of upper and lower external wall panels 6*a* and 6*b*, and a base member 100 made of metallic material is fixed to the water draining member 8. Utilizing upper and lower elastic engaging portions 101 and 102 formed to the fixed base member 100, a fiber reinforced cement siding type modesty panel main body 110 equipped with a downwardly protruded ridge 111 formed along the upper edge of the rear surface and a U-shaped groove 112 formed along the lower edge of the rear surface is attached. In this construction structure, the attaching of the modesty panel main body 110 can be performed easily and with no nail head, etc., and would not be exposed to the surface of the modesty panel main body 110, resulting in preferable appearance (see Japanese Unexamined Laid-open Patent Publication No. 2002-89008).

Fiber reinforced cement siding type modesty panels give a feeling of dignity, which is preferable. However, the workability is not so good due to its heavy weight, and it is required to perform decorative coating on the surface of the modesty panel. Under the circumstances, a modesty panel using resin material or metallic material is also proposed (see Japanese Unexamined Laid-open Patent Publication No. 2001-271485 and Japanese Unexamined Laid-open Patent Publication No. H10-96319). The modesty panel of this type is light in weight as compared with a fiber reinforced cement siding type modesty panel, and therefore the workability can be improved.

FIGS. 16 and 17 show a modesty panel disclosed by the aforementioned Japanese Unexamined Laid-open Patent Publication No. H10-96319. This modesty panel includes a base member 120 and a modesty panel main body 130. As shown in FIG. 17, the base member 120 has a flat portion 121 served as a fixing surface to an external wall surface 2, and upper and lower engaging stepped portions 123 and 124 are formed in parallel with each other at the upper and lower edges of the flat portion 121, respectively. The modesty panel main body 130 has a surface portion 131 and upper and lower engaging ridges 132 and 133 formed at the upper and lower edges of the modesty panel main body 130 to be outwardly engaged with the upper and lower engaging stepped portions 123 and 124, respectively.

At the time of the construction work, the base member 120 is fixed to the external wall surface 2 with nails 3 at intervals corresponding to the length of the modesty panel main body 130, and the upper and lower engaging ridges 132 and 133 of the modesty panel main body 130 are outwardly engaged with the upper and lower engaging stepped portions 123 and 124 of the fixed base member 120, respectively. As a result, as shown in FIG. 17, the base member 120 and the modesty panel main body 130 are integrally joined.

The modesty panel 130, as shown in FIGS. 16 and 17, is an integrally molded resin article light in weight and excellent in workability. The manufacturing thereof can be performed easily and an excellent surface design can also be secured without coating with paint. However, since the fixing surface of the base member 120 to the external wall surface 2 is formed into a large flat surface 121, it is not easy to fix the base member 120 to the external wall surface 2 if there exists unevenness on the external wall surface 2 of a building side and/or a water draining member 8 is mounted between the upper and lower external wall panels 6*a* and 6*b* as shown in FIG. 15. Furthermore, the fixing of the modesty panel main body 130 to the base member 120 is performed only by the outward-engagement of the upper and lower engaging stepped portions 123 and 124 of the base member 120 and the upper and lower engaging ridges 132 and 133 of the modesty panel main body 130, which may sometimes cause unstable engagement.

The description herein of advantages and disadvantages of various features, embodiments, methods, and apparatus disclosed in other publications is in no way intended to limit the present invention. For example, certain features of the preferred embodiments of the invention may be capable of overcoming certain disadvantages and/or providing certain advantages, such as, e.g., disadvantages and/or advantages discussed herein, while retaining some or all of the features, embodiments, methods, and apparatus disclosed therein.

SUMMARY OF THE INVENTION

The preferred embodiments of the present invention have been developed in view of the above-mentioned and/or other problems in the related art. The preferred embodiments of the present invention can significantly improve upon existing methods and/or apparatuses.

Among other potential advantages, some embodiments can provide a modesty panel capable of being attached to a fixing surface of a building side regardless of the unevenness of the surface of the fixing surface.

Among other potential advantages, some embodiments can provide a construction structure using the modesty panel.

According to one aspect of some embodiments of the present invention, a modesty panel, having:

a base member to be attached to an external wall portion, the base member being made of metallic material or resin material; and a modesty panel main body to be attached to the external wall portion via the base is member, the modesty panel main body being made of metallic material or resin material, wherein the base member is integrally provided with a surface portion, an upper attaching portion extending along an upper edge of the surface portion, and a lower attaching portion extending along a lower edge of the surface portion, wherein a first engaging stepped portion and a second engaging stepped portion are formed in a vicinity of the upper attaching portion of the base member and a vicinity of the lower attaching portion of the base member, respectively, the first engaging stepped portion and the second engaging stepped portion being arranged in parallel with each other, wherein the modesty panel main body is provided with a surface portion, a first engaging ridge integrally formed in a vicinity of an upper edge of the surface portion so as to be engaged with the first engaging stepped portion of the base member, a second engaging ridge integrally formed in a vicinity of a lower edge of the surface portion so as to be engaged with the second engaging stepped portion of the base member, the first engaging ridge and the second engaging ridge being arranged in parallel with each other, wherein, in a state in which the first and second engaging ridges of the modesty panel main body are outwardly engaged with the first and second engaging stepped portions of the base member, respectively, the vicinity of the upper edge of the surface portion of the modesty panel main body and the vicinity of the upper edge of the surface portion of the base member form a superimposed region configured to fix the modesty panel main body and the base member with a fixing screw.

According to this modesty panel, the modesty panel is made of metallic material or resin material, and therefore the weight saving can be attained, resulting in good workability. The integral molding can be performed easily by extrusion molding or the like. The attaching of the base member to the building side is performed only by the upper and lower attaching portions integrally formed along the upper and lower edges of the surface portion, and a space is formed between the base member and the building surface. This enhances the adaptability of the modesty panel relative to unevenness of an external wall surface, which in turn can remarkably stabilize the fixed state of the base member relative to the external wall surface as compared with the case in which the entire rear surface of a base member constitutes a fixing surface. Furthermore, even in cases where a water draining member is mounted between upper and lower external wall panels, by locating the water draining member in the space formed between the upper attaching portion and the lower attaching portion, the stable fixing of the base member to the external wall panel can be attained.

Furthermore, according to the aforementioned modesty panel, when the first and second engaging ridges of the modesty panel main body are outwardly engaged with the first and second engaging stepped portion of the base member, the vicinity of the upper edge of the surface portion of the modesty panel main body and the vicinity of the upper edge of the surface portion of the base member form the superimposed region. Therefore, by screwing a fixing screw into the superimposed region, the modesty panel main body and the base member can be stably fixed with each other by the fixing using the fixing screw in addition to the engagement of the engaging ridge and the engaging stepped portion.

In order to facilitate the screw fixing at the aforementioned superposition portion, it is preferable to form a dented groove at least on the surface of the superimposed portion of the modesty panel main body along the upper edge thereof. This dented groove can be formed simultaneously with the manufacturing of the modesty panel main body in the case of manufacturing the modesty panel main body by extrusion molding. It is preferable to form the same dented groove on the surface of the base member.

In the aforementioned modesty panel, it is preferable that the base member is provided with a first opening formed in a region facing to the upper attaching portion of the base member and a second opening formed in a region facing to the lower attaching portion of the base member, each of the openings being defined as a tool insertion hole to be used when the base member is attached to the external wall portion with screws. In this case, a fixing screw and a screw rotating tool can be inserted through each opening formed in the base member, which facilitates the fixing operation of the base member to the external wall surface.

In the aforementioned modesty panel, it is preferable that the upper attaching portion of the base member is integrally provided with a protruded ridge or protrusion having a tip serving as a contacting portion to be brought into contact with an external wall surface, and that the lower attaching portion of the base member is integrally provided with a protruded ridge or protrusion having a tip serving as a contacting portion to be brought into contact with an external wall surface. In this case, when the base member is fixed to the external wall surface, the base member comes into contact with the external wall surface only at the tip end face of the protruded ridge or the protrusion, the attaching degree of freedom of the base member to the unevenness of the external wall surface is further increased.

In the aforementioned modesty panel, it is preferable that the vicinity of the upper edge of the surface portion of the base member to be superimposed by the vicinity of the upper edge of the surface portion of the modesty panel main body is inclined forwardly obliquely downward and that the vicinity of the upper edge of the surface portion of the modesty panel main body to be superimposed by the vicinity of the upper edge of the surface portion of the base member is inclined forwardly obliquely downward. In this case, the screwing direction of the fixing screw can be set to a direction perpendicular to the inclined surface, securing a larger tool operation space at the time of screwing the fixing screw using a power tool, etc., which in turn can facilitate the screwing operation of the fixing screw at the time of the construction work.

In the aforementioned modesty panel, it is preferable that the base member has a vertical plate formed at a position lower than the second engaging stepped portion and the modesty panel main body has a vertical plate formed at a position lower than the second engaging ridge so as to face to the vertical plate of the base member when the modesty panel main body is integrally combined with the base member and an inwardly extended horizontal plate formed at a lower end of the vertical plate of the modesty panel main body so as to extend over the vertical plate of the base member when the modesty panel main body is integrally combined with the base member. In this case, the horizontal plate can hide the screw fixing the base member to the external wall surface so that the screw cannot be observed from underneath. It is more preferable that the length of the horizontal plate is set so that a slight clearance is formed between the tip of the horizontal plate and the external wall surface when the modesty panel main body is attached to the base member. This enhances smooth downward flow of rain water along the external wall surface, thereby preventing generation of raindrop stain.

The configuration of the surface portion of the modesty panel main body as seen from its side can be arbitrarily set so long as it can be integrally formed, and can be, e.g., a flat configuration, a stepped configuration, or a curved configuration. From the viewpoint of design appearance and easiness of attaching the modesty panel to the base member, it is preferable that the surface portion of the modesty panel main body is formed into a curved surface as seen from its side. In the same manner, the side view configuration of the surface portion of the base member can also be arbitrarily set, and can be, e.g., a flat configuration, a stepped configuration, or a curved configuration. According to one of preferable embodiments of the base member, the surface portion of the base member is formed into a curved surface as seen from its side so that a clearance is formed between the surface portion of the modesty panel main body and the surface portion of the base member when the modesty panel main body is integrally combined with the base member. As mentioned above, by forming the surface portions of the modesty panel main body and the base member into curved surfaces different in curvature to form a clearance therebetween, at the time of fixing the modesty panel main body to the base member, it becomes possible to prevent the modesty panel main body outwardly engaged with the base member from being detached from the base member. Moreover, the clearance can also be used as an insertion space for, inserting, e.g., a reinforcing member of an external corner member or an internal corner member or an end cap.

It is more preferable that each of the modesty panel main body and the base member is an aluminum integrally molded article. An aluminum extrusion molded article is good in formability, proper in elasticity, excellent in design appearance as it is, and also excellent in weather resistance. As described above, however, it can be a resin integrally molded article excellent in weather resistance such as, e.g., AES resin.

According to another aspect of some embodiments of the present invention, an external wall construction structure can use the modesty panel, wherein external wall panels are fixed to a building external wall surface, wherein the base member is fixed to the external wall panels with screws in a state in which rear ends of the upper attaching portion and the lower attaching portion are brought into contact with the external wall panels, wherein the modesty panel main body is fixed to the base member in a state in which the first engaging ridge of the modesty panel main body and the second engaging ridge thereof are outwardly engaged with the first engaging stepped portion of the base member and the second engaging stepped portion thereof, respectively, and wherein the superimposed region formed by the vicinity of the upper edge of the surface portion of the base member and the vicinity of the upper edge of the surface portion of the modesty panel main body is fixed with a screw.

According to the external wall construction structure, in the construction work, the external wall panel is fixed to the building external wall surface in accordance with a conventional method. The fixing of the external wall panel can be nail fixing or metal fixing using a fastening member. The base members are fixed to the surface of the fixed external wall panels with screws at predetermined intervals in a horizontal direction. At that time, the rear surfaces of the upper and lower attaching portions of the base member are brought into contact with the external wall panel, and then the upper and lower attaching portions are fixed to the external wall panel with screws. The aforementioned predetermined interval is basically set to the same distance as the length of the modesty panel main body to be used. At a portion shorter than a length of the modesty panel main body, the base member is fixed to the portion and the modesty panel main body is cut in accordance with the length of the portion.

The modesty panel main body is attached to the base members with the length of the modesty panel main body covering the corresponding base members. Initially, the first engaging ridge integrally formed in the vicinity of the upper edge of the modesty panel main body is outwardly engaged with the first engaging stepped portion of the fixed base member. With this posture, the surface portion of the modesty panel main body is pressed toward the base member. As a result, the second engaging ridge integrally formed in the vicinity of the lower edge of the modesty panel main body climbs over the second engaging stepped portion of the fixed base member, and enters the inside of the second engaging stepped portion. Finally, the second engaging ridge is outwardly engaged with the second engaging stepped portion. Thus, the modesty panel main body is temporarily fixed to the base member.

By the temporary fixing, a superimposed region in which the vicinity of the upper edge of the surface portion of the modesty panel main body and the vicinity of the upper edge of the base member surface portion are superimposed is formed at both end portions of the modesty panel main body. Then, a fixing screw is screwed into the superimposed region. As a result, the modesty panel main body is securely fixed to the base member, resulting in an external wall construction structure equipped with the modesty panel. Since the modesty panel main body and the base member are fixed with a screw, they never separate even if they receive external force. In cases where the modesty panel main body is required to be removed due to improvement work, etc., the modesty panel main body can be removed easily by removing the fixing screw.

In the aforementioned external wall construction structure, the length of the screw for fixing the base member to the external wall panel can be arbitrarily set. However, it is preferable that a long screw is screwed into a building external wall surface constituting member like a furring strip over the external wall panel. By this, the fixing of the base member to the external wall material becomes stable, resulting in stable fixing structure of the modesty panel.

In the external wall construction structure using the aforementioned modesty panel, the attaching position of the modesty panel on the external wall surface can be set arbitrarily. For example, the modesty panel can be attached to the position forming a boundary between a first floor external wall surface and a second floor external wall surface in order to give an accent. Alternatively, the modesty panel can be attached for the purpose of concealing the clearance formed between upper and lower external wall panels fixed to a building external wall surface. In the latter case, an upper external wall panel and a lower external wall panel are fixed to the building external wall surface in an adjacently arranged manner, and the upper attaching portion of the base member and the lower attaching portion thereof are fixed to a lower end portion of the upper external wall panel and an upper end portion of the lower external wall panel, respectively. As described above, a space is formed between the upper attaching portion of the base member and the lower attaching portion thereof. Therefore, even in cases where a water draining member is mounted between the upper and lower external wall panels, the base member can be stably fixed to the external wall panels.

According to some preferred embodiments, a lightweight modesty panel made of resin material or metallic material can be stably fixed to a building side regardless of the fixing status of the building side.

The above and/or other aspects, features and/or advantages of various embodiments will be further appreciated in view of the following description in conjunction with the accompanying figures. Various embodiments can include and/or exclude different aspects, features and/or advantages where applicable. In addition, various embodiments can combine one or more aspect or feature of other embodiments where applicable. The descriptions of aspects, features and/or advantages of particular embodiments should not be construed as limiting other embodiments or the claims.

BRIEF DESCRIPTION OF THE DRAWINGS

The preferred embodiments of the present invention are shown by way of example, and not limitation, in the accompanying figures, in which.

DETAILED DESCRIPTION OF THE PREFERRED EMBODIMENTS

In the following paragraphs, some preferred embodiments of the invention will be described with reference to the attached drawings by way of example and not limitation. It should be understood based on this disclosure that various other modifications can be made by those in the art based on these illustrated embodiments.

Figure 1:
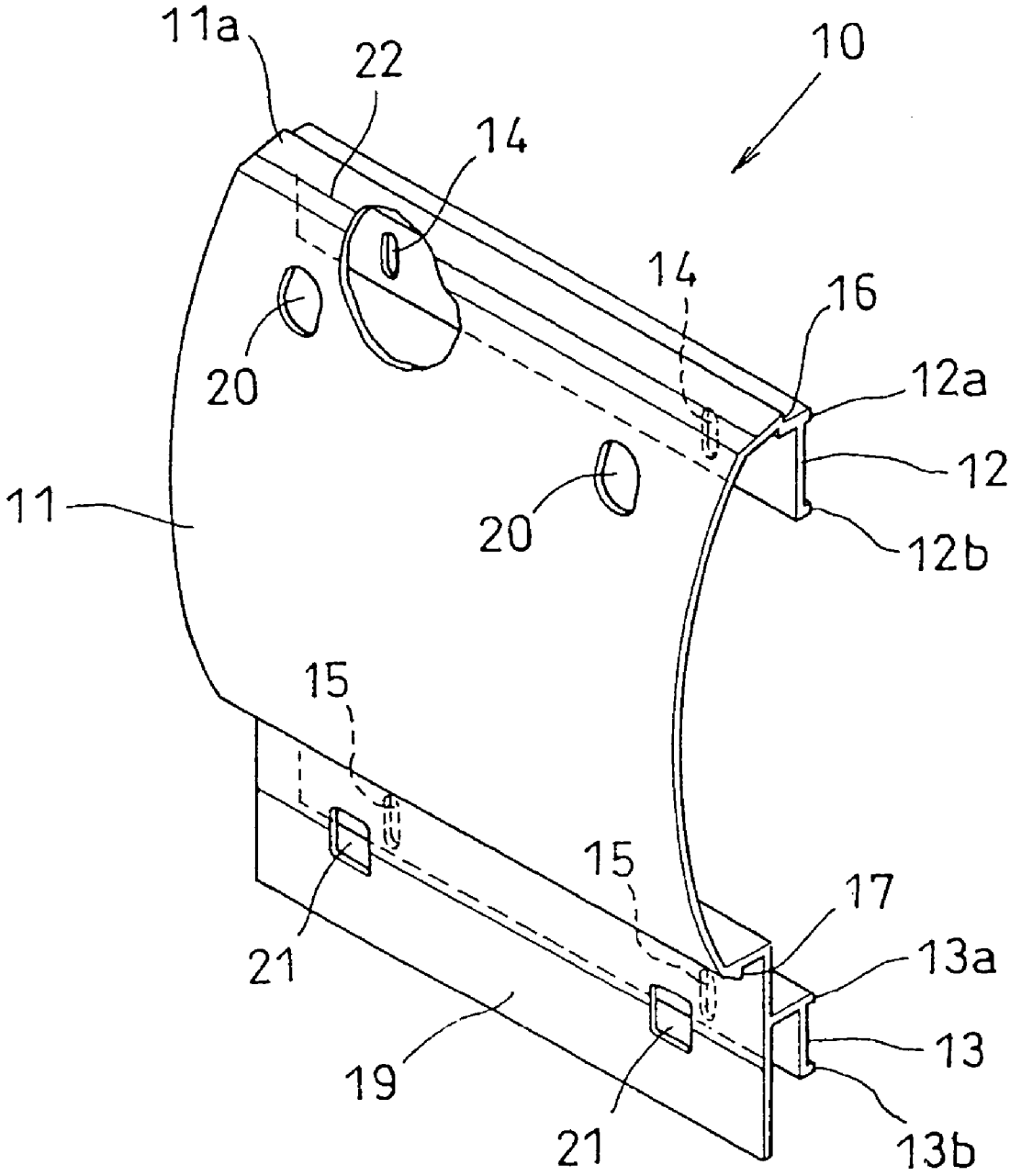
FIG. 1 is a perspective view showing a base member constituting a modesty panel according to an embodiment of the present invention.
Figure 2:
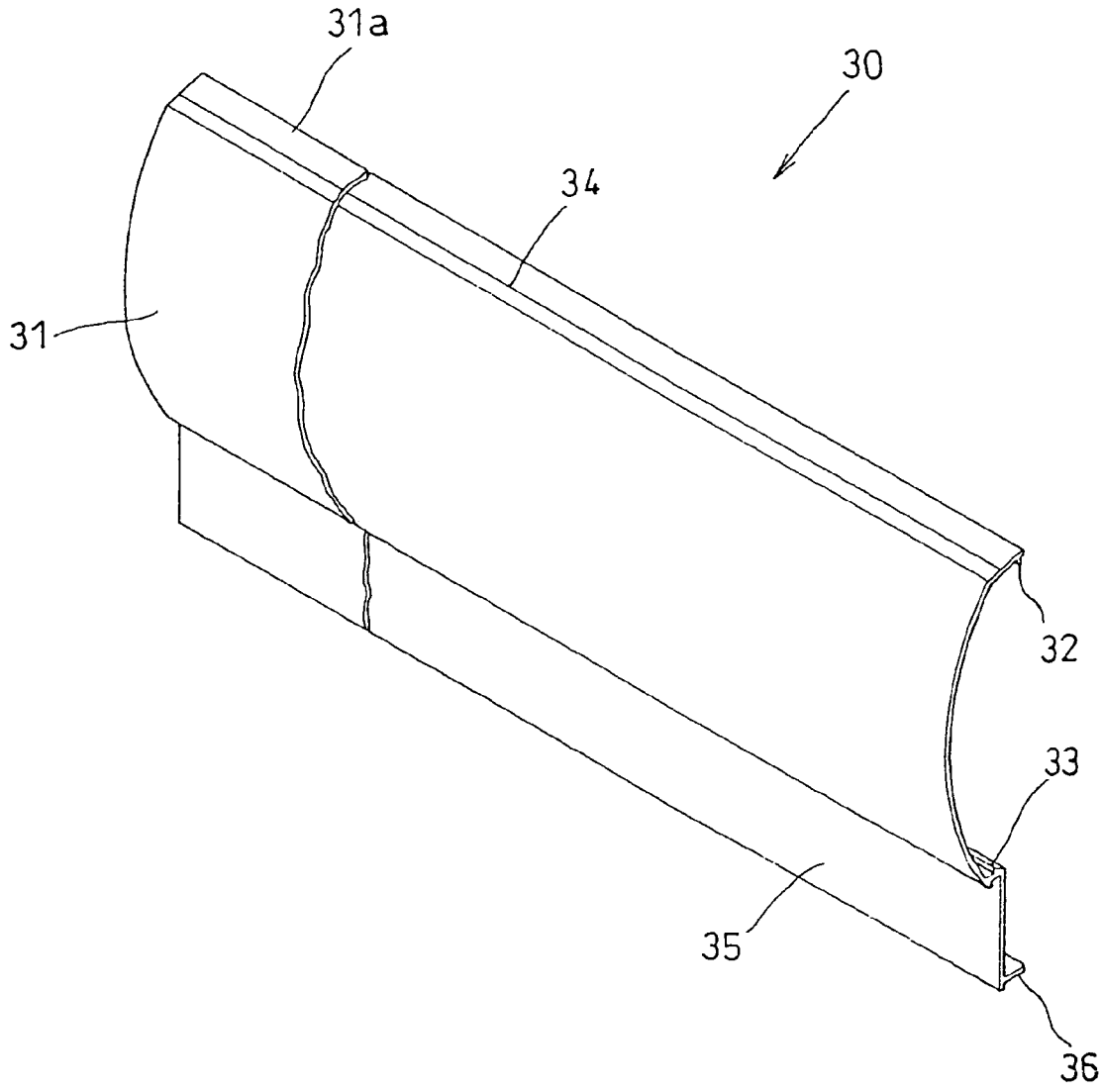
FIG. 2 is a perspective view showing a modesty panel main body constituting the modesty panel according to an embodiment of the present invention.
Figure 3:
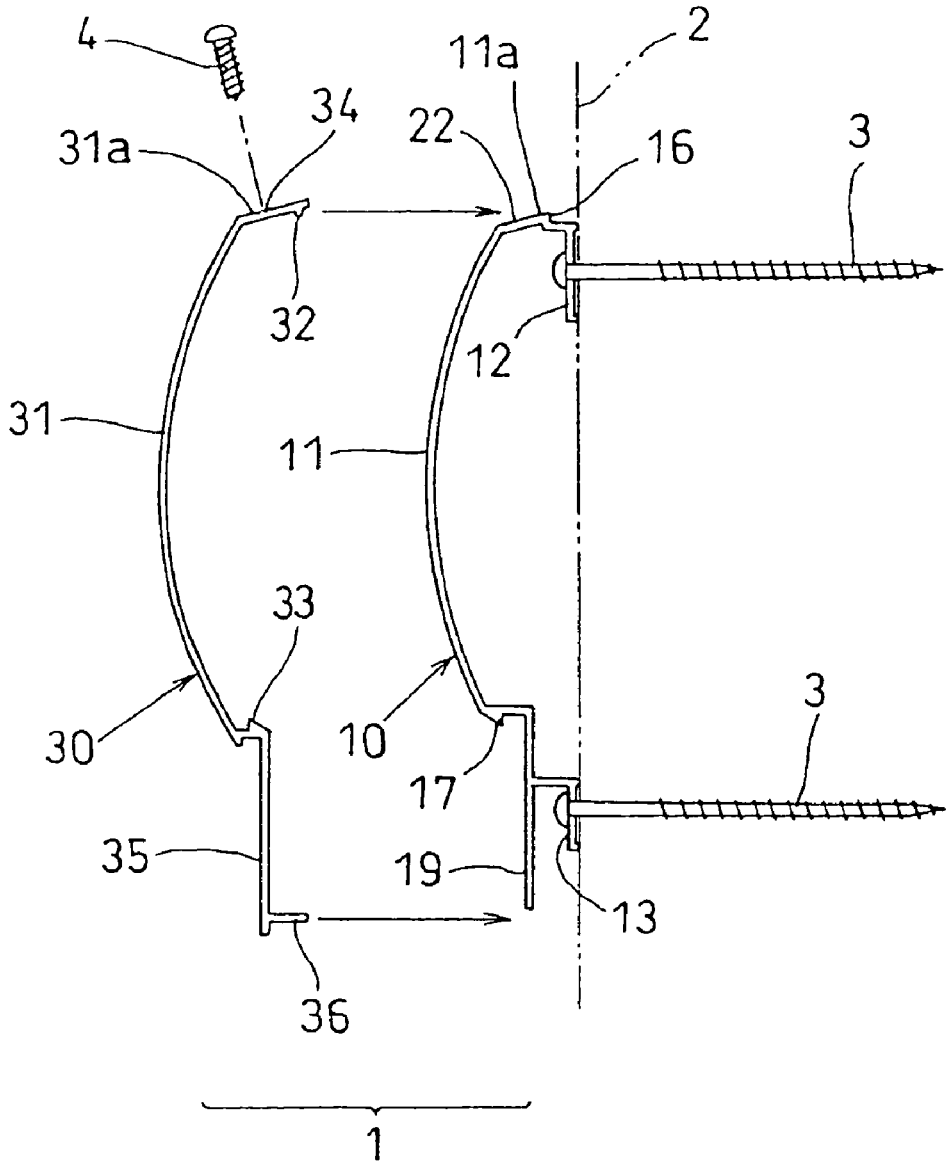
FIG. 3 is an explanatory view for explaining the construction work procedure of the modesty panel.
Figure 4:
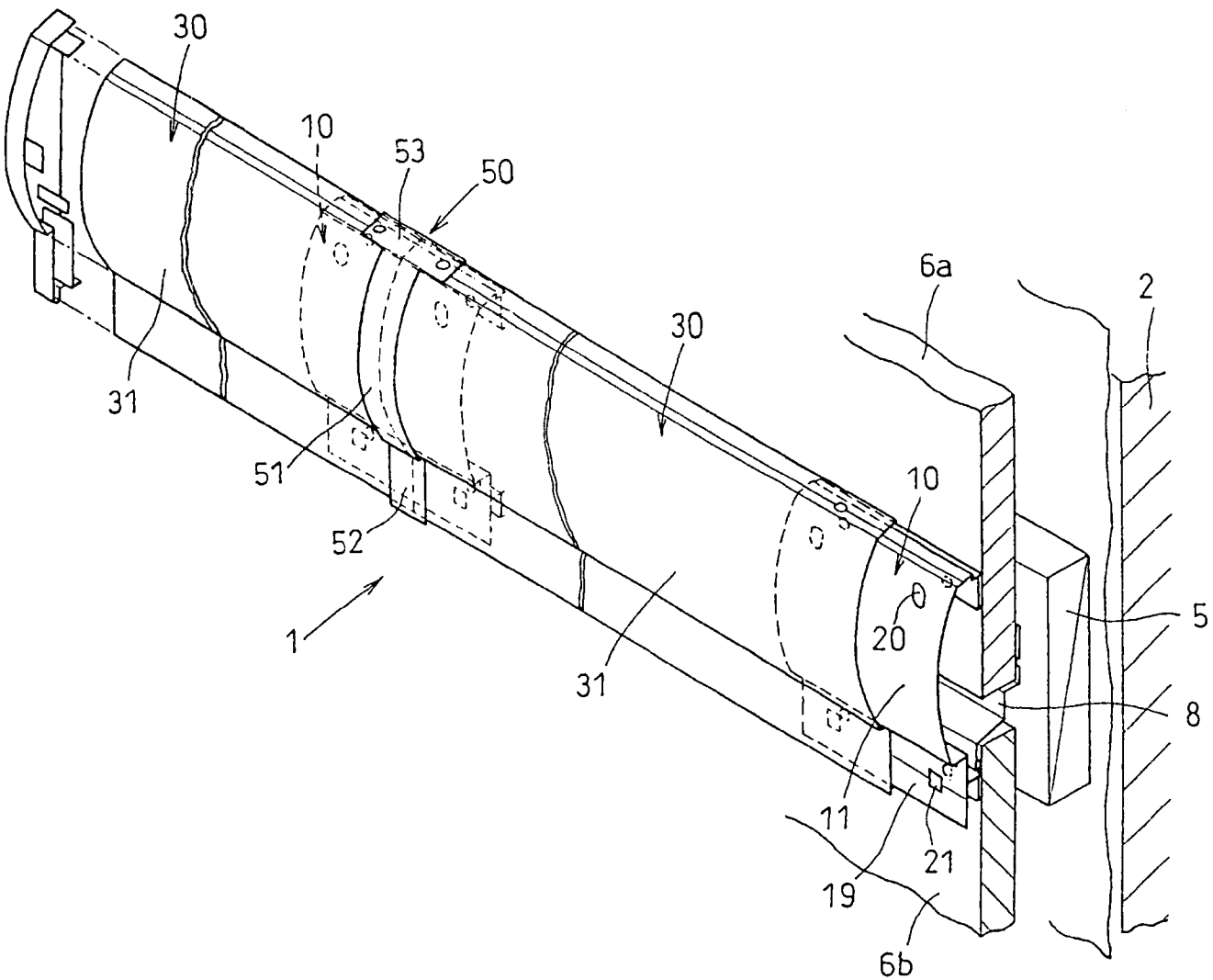
FIG. 4 is a perspective view showing an external wall construction structure after fixing the modesty panel.
Figure 5:
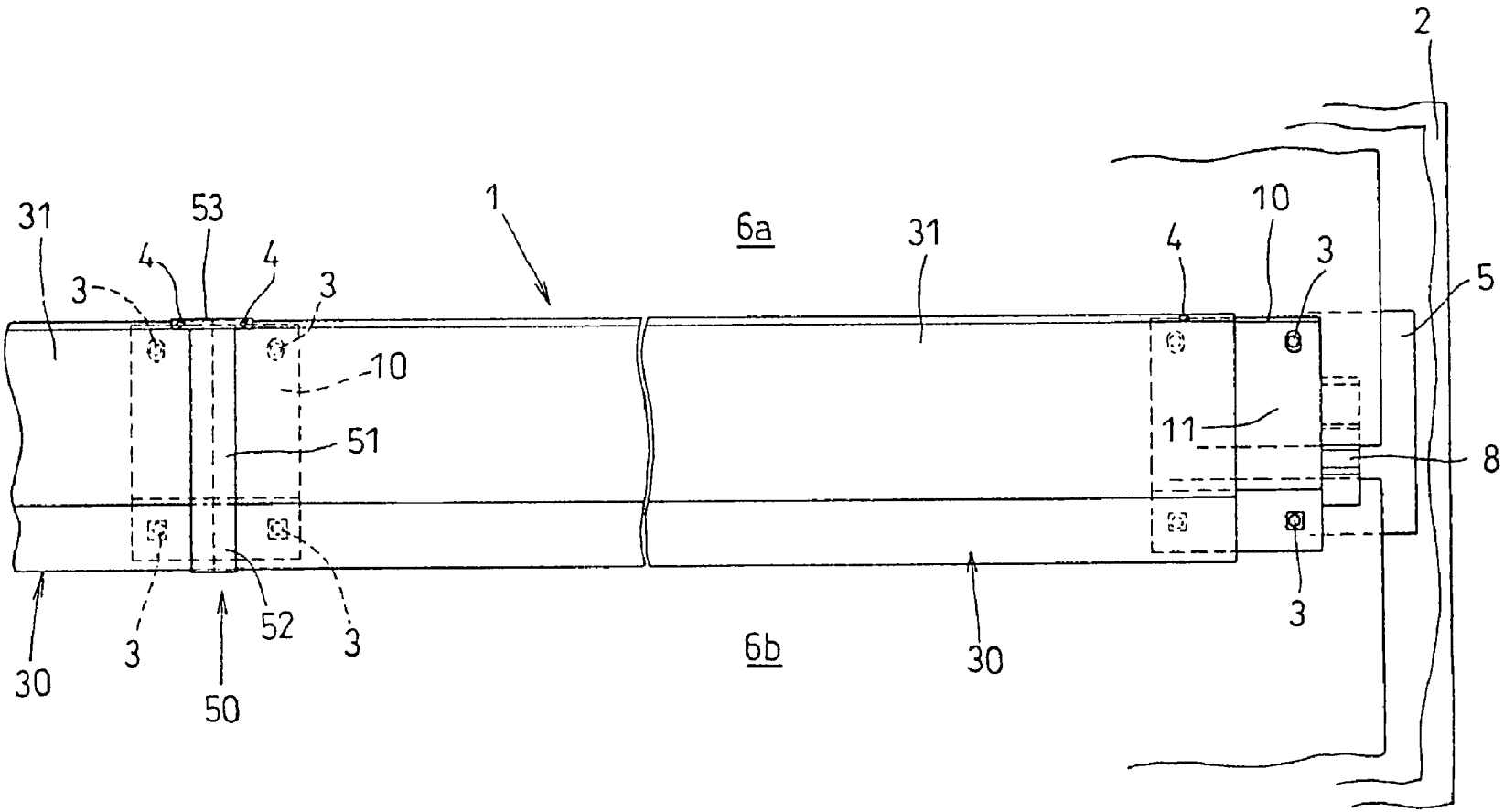
FIG. 5 is a front view showing the external wall construction structure shown in FIG. 4.
Figure 6:
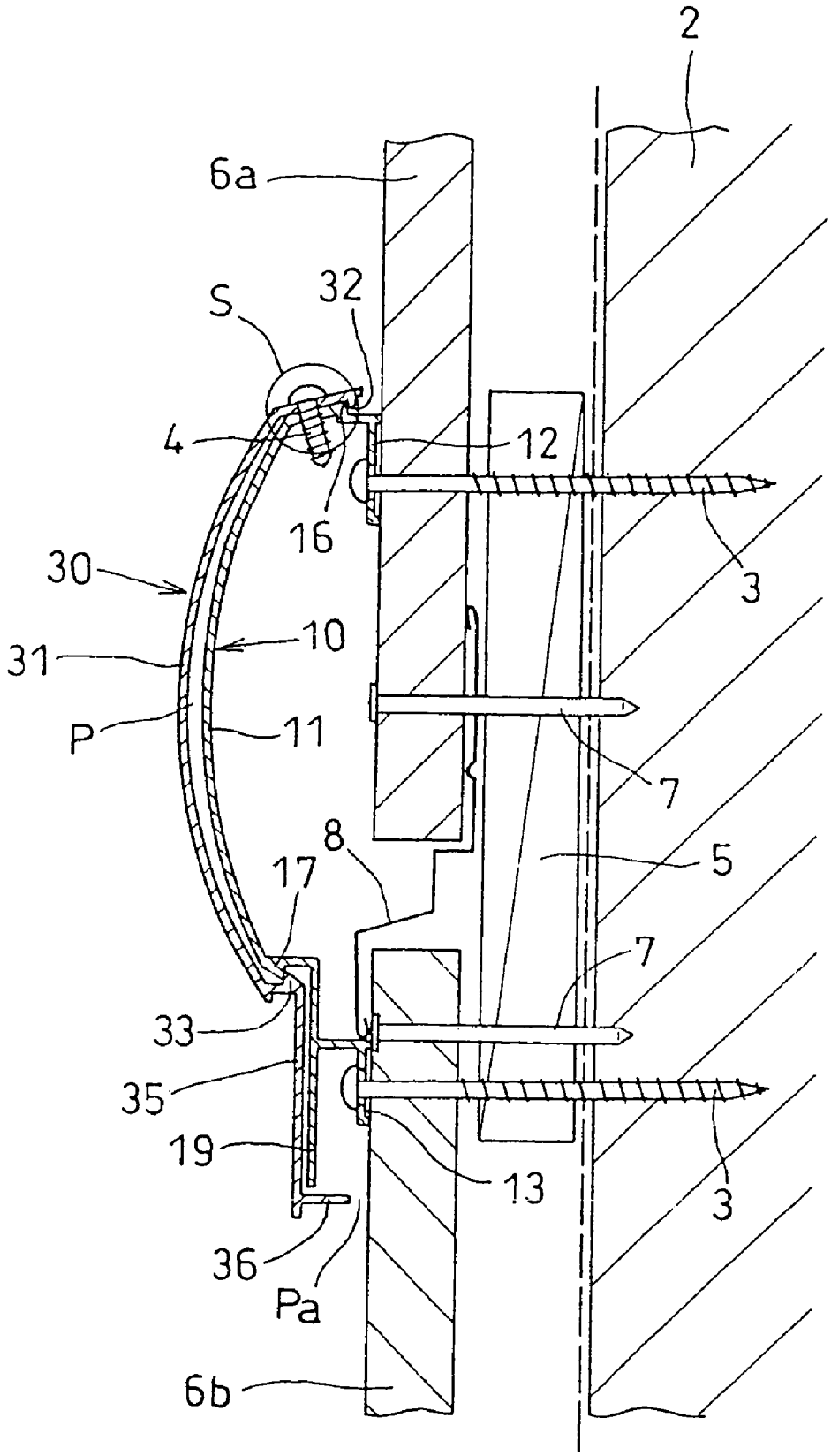
FIG. 6 is a cross-sectional view showing the external wall construction structure shown in FIG. 4.

FIG. 1 is a perspective view showing a base member according to an embodiment of the present invention, FIG. 2 is a perspective view showing a modesty panel main body according to an embodiment of the present invention, FIG. 3 is an explanatory view for explaining the construction work procedure of the modesty panel, FIG. 4 is a perspective view showing an external wall construction structure after fixing the modesty panel, FIG. 5 is a front view showing the external wall construction structure shown in FIG. 4, and FIG. 6 is a cross-sectional view showing the external wall construction structure shown in FIG. 4.

A modesty panel 1 includes a base member 10 and a modesty panel main body 30. In this embodiment, each of the base member 10 and the modesty panel main body 30 is an integrally molded aluminum extruded article.

The base member 10 has a surface portion 11, an upper attaching portion 12 formed along an upper edge of the surface portion 11 and a lower attaching portion 13 formed along a lower edge of the surface portion 11. Each of the upper and lower attaching portions 12 and 13 is provided with a vertically extended elongated hole 14 and 15 for passing a fixing screw at the time of fixing the base member 10 to a building side. The upper attaching portion 12 has, at its rear surface, two protruded ridges 12*a* and 12*b* extending in the longitudinal direction. In the same manner, the lower attaching portion 13 has, at its rear surface, two protruded ridges 13*a* and 13*b* extending in the longitudinal direction. The tips of the protruded ridges 12*a*, 12*b*, 13*a* and 13*b* are positioned on the same flat surface. In the vicinity of the upper attaching portion 12 of the surface portion 11, a first engaging stepped portion 16 is formed. In the vicinity of the lower attaching portion 13 of the surface portion 11, a second engaging stepped portion 17 is formed in parallel with the first engaging stepped portion 16. In some preferred embodiments, the protruded ridges 12*a*, 12*b*, 13*a* and 13*b* can be omitted.

The side view configuration of the surface portion 11 is not specifically limited and can be, e.g., a flat configuration. In this embodiment, the surface portion 11 is formed into a generally curved side view configuration as shown in FIG. 1. The region near the upper edge and adjacent to the first engaging stepped portion 16 is formed into a flat surface region 11*a* inclined obliquely downward. Moreover, at a position lower than the second engaging stepped portion 17 of the surface portion 11, a vertical plate 19 is formed.

At the position of the surface portion 11 facing to the elongated hole 14 formed in the upper attaching portion 12, a first opening 20 is formed. Furthermore, at the position of the vertical plate 19 facing to the elongated hole 15 formed in the lower attaching portion 13, a second opening 21 is formed. These openings 20 and 21 are used as through holes each for passing a fixing screw and a rotating tool at the time of fixing the base member 10 to a building side. Furthermore, in the flat surface region 11*a* of the surface portion 11 inclined obliquely downward, a cutout groove 22 extending in the longitudinal direction is formed. As will be explained later, this cutout groove 22 can be served as a guide groove of a fixing screw at the time of fixing the modesty panel main body 30 to the base member 10. In some preferred embodiments, this cutout groove 22 can be omitted.

The modesty panel main body 30 has a surface portion 31, a first engaging ridge 32 extending in the longitudinal direction and integrally formed in the vicinity of the upper edge of the surface portion 31, and a second engaging ridge 33 extending in the longitudinal direction and integrally formed in the vicinity of the lower edge of the surface portion 31. The first engaging ridge 32 and the second engaging ridge 33 are arranged in parallel with each other. The configurations of the first engaging ridge 32 and the second engaging ridge 33 and the distance therebetween are set such that, when the modesty panel main body 30 is pressed against the base member 10 from the front, the first and second engaging ridges 32 and 33 are brought into contact with the corresponding first and second engaging stepped portions 16 and 17 of the base member 10 from the front and then outwardly engaged therewith in an undetachable manner after climbing over the engaging stepped portions 16 and 17 due to the elasticity of the modesty panel main body 30.

The side view configuration of the surface portion 31 of the modesty panel main body 30 can be set arbitrarily so long as the surface portion 31 can be outwardly engaged with the base member 10 without coming into contact with the surface portion 11 of the base plate 10. For example, the surface portion 31 can be formed into a flat configuration or a stepped configuration. In this embodiment, it is formed into a generally curved side view configuration as shown in FIG. 2. The region near the upper edge of the surface portion 31 and adjacent to the first engaging ridge 32 is formed into a flat surface region 31*a* inclined obliquely downward. This flat surface region 31*a* forms a superimposed region S (see FIG. 6) with the flat surface region 11*a* of the base member 10 when the modesty panel main body 30 is integrally outwardly engaged with the base member 10. A cutout groove 34 extending in the longitudinal direction is also formed in a position of the flat surface region 31*a* facing to the cutout groove 22 formed in the flat surface region 1*a* of the base member 10 when the superimposed region S is formed. This cutout groove 34 is served as a guide groove for a fixing screw at the time of fixing the modesty panel main body 30 to the base member 10. In some preferred embodiments, this cutout portion groove 34 can be omitted.

In cases where the surface portion 31 of the modesty panel main body 30 is formed into a curved configuration, as shown in the illustrated embodiment, it is preferable that the curvature of the surface portion 31 is different from that of the base member 10 so that, when both of them are integrally engaged with each other, a slight clearance P (see FIG. 6) is formed between the surface portion 11 of the base member 10 and the surface portion 31 of the modesty panel main body 30. This slight clearance P can avoid a danger of detaching the modesty panel main body 30 from the base member 10 at the time of fixing the modesty panel main body 30 to the base member 10 with a screw.

At a portion of the surface portion 31 of the modesty panel main body 30 lower than the second engaging ridge 33, a vertical plate 35 is formed. At the lower end of this vertical plate 35, an inwardly extended horizontal plate 36 which extends beyond the vertical plate 19 of the base member 10 when the modesty panel main body 30 is outwardly engaged with the base member 10 is formed.

Now, the steps of attaching the modesty panel 1 to a building side will be explained with reference to FIG. 3. In FIG. 3, the reference numeral "2" denotes an external wall surface of a building side. Initially, base members 10 are fixed to the external wall surface 2 at intervals corresponding to the length of the modesty panel main body 30 to be fixed (also see FIG. 5). At the time of fixing the base members 10, the rear surfaces of the upper and lower attaching portions 12 and 13 of the base member 10 are brought into contact with the external wall surface 2. Fixing screws 3 are inserted into the elongated holes 14 and 15 through the openings 20 and 21 formed in the surface portion 11 and the vertical plate 19, and then the tip of each screw 3 is screwed into a building side using a proper rotating tool (not shown). Thus, the base member 10 is brought into contact with the building side only at its rear surfaces of the upper and lower attaching portions 12 and 13. In the illustrated embodiment, only the tips of the protruded ridges 12*a* and 13*a* are brought into contact with the building side, which enables the fixing of the base member 10 even if unevenness exists on the building external wall surface 2.

With this fixed state of the base member 10, the modesty panel main body 30 is pressed against the base member 10 with both ends of the modesty panel main body 30 disposed on the base members 10 and 10 fixed on the building side at a certain distance. Alternatively, the first engaging ridge 32 of the modesty panel main body 30 is engaged with the first engaging stepped portion 16 of the base member 10, and then the modesty panel main body 30 is rotated counterclockwise. By this operation, the first and second engaging ridges 32 and 33 are outwardly engaged with the first and second engaging stepped portions 16 and 17 of the base member 10, respectively, whereby the modesty panel main body 30 is integrally engaged with the base member 10.

In this integrally engaged state, the flat surface region 11*a* of the base member 10 and the flat surface region 31*a* of the modesty panel main body 30 form a superimposed region S inclined obliquely downward as shown in FIG. 6. In the region S, the cutout grooves 22 and 34 are formed. By rotating a fixing screw 4 with a rotating tool (not shown) in a state in which the tip of the fixing screw 4 is placed in the cutout groove 34, both the flat surface regions 31*a* and 11*a* are integrally secured with the fixing screw 4. Since the superimposed region S is inclined obliquely downward, the screw fixing operation using a tool can be facilitated.

An example of the external wall construction structure in which the modesty panel 1 is fixed is shown in FIGS. 4 to 6. In this illustrated example, a horizontal furring strip 5 is attached to the building external wall surface 2. Using this furring strip 5, external wall is panels 6 are fixed vertically. Between the upper external wall panel 6*a* and the lower external wall panel 6*b*, a water draining member 8 is mounted. This external wall construction structure itself is a conventionally known structure.

As shown in FIG. 5, a plurality of base members 10 are fixed to the external wall surface 2 at intervals corresponding to the length of the modesty panel main body 30. In the illustrated example, each base member 10 is fixed to the external wall panels 6 in a state in which the upper attaching portion 12 is put on the lower end side of the upper external wall panel 6*a* and the lower attaching portion 13 is put on the upper end side of the lower external wall panel 6*b*. As the fixing screw 3, a long screw which reaches the building external wall surface 2 via the horizontal furring strip 5 is used, resulting in stable fixing. Between the upper attaching portion 12 of the base member 10 and the lower attaching portion 13 thereof, a space is formed. Therefore, even if the water draining member 8 is mounted between the upper and lower external wall panels 6*a* and 6*b*, the water draining member 8 exerts no influence on the fixing of the base member 10.

In a state in which both ends of the modesty panel main body 30 are placed on the right and left base members 10 and 10 as shown in FIG. 5, the modesty panel main body 30 is fixed to the base members 10 as explained with reference to FIG. 3. Since a slight clearance P is formed between the surface portion 11 of a base member 10 and the surface portion 31 of the modesty panel main body 30 as described above, the modesty panel main body 30 would not be detached from the base member 10 at the time of fixing the modesty panel main body 30 to the base member 10 with the fixing screw 4. Furthermore, since the horizontal plate 36 is formed at the lower end of the modesty panel main body 30, the head of the fixing screw 3 cannot be observed from the below, resulting in good appearance. Since a clearance Pa is formed between the tip of the horizontal plate 36 and the front surface of the external wall panel 6*b*, rain water would not be dammed by the horizontal plate 36.

In the aforementioned construction structure, in some cases, a slight clearance can be formed at the abutted portion of the right and left modesty panel main bodies 30 and 30 depending on the construction work. Such a clearance is slight and would cause no special problem even if it remains as it is. However, such a clearance can be covered with a joint member 50 as shown, e.g., in FIG. 7. FIGS. 4 and 5 show an embodiment in which such a joint portion member 50 is used.

Figure 7:
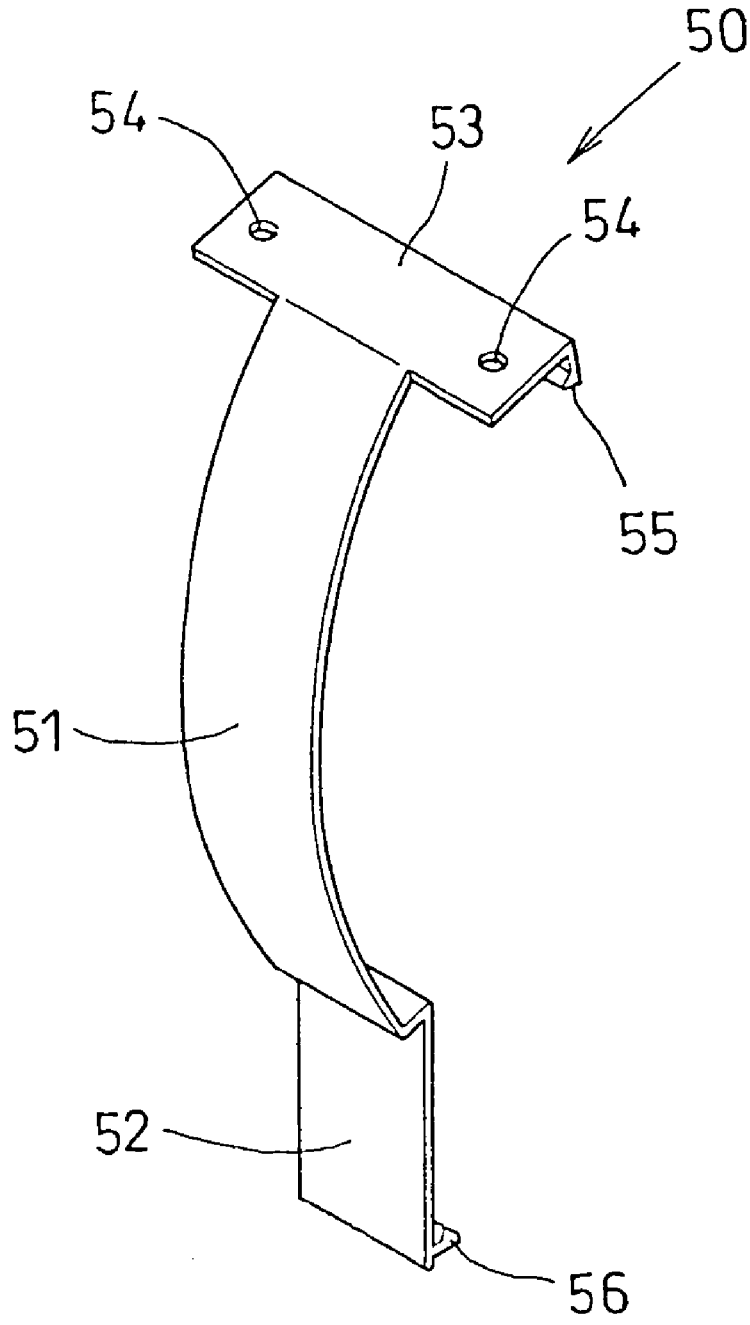
FIG. 7 is a perspective view showing a joint member preferably used in an embodiment of the present invention.

The joint member 50 can be an aluminum member or an AES resin member. As shown in FIG. 7, the joint member 50 has a surface curved portion 51 and a vertical portion 52 having a side view configuration corresponding to the side view configuration of the surface portion 31 and the vertical plate 35 of the modesty panel main body 30. The upper region of the surface curved portion 51 is formed into a flat surface 53 facing to the flat surface region 31*a* of the surface portion 31 of the modesty panel main body 30 inclined obliquely downward. In the flat surface 53, openings 54 for screws are formed. At the tip of the flat surface 53, an engaging ridge 55 to be engaged with the upper edge of the modesty panel main body 30 is formed. Moreover, at the lower end of the vertical portion 52, an engaging ridge 56 to be engaged with the lower edge of the vertical plate 35 of the modesty panel main body 30 is formed.

As shown in FIGS. 4 and 5, the joint member 50 is firmly fixed to the modesty panel 1 by screwing fixing screws through the screw openings 54 and 54 in a state in which the joint member 50 covers the abutted portion of the right and left modesty panel main bodies 30 and 30 with the upper and lower engaging ridges 55 and 56 engaged with the upper and lower edges of the modesty panel main body 30.

Figure 8:
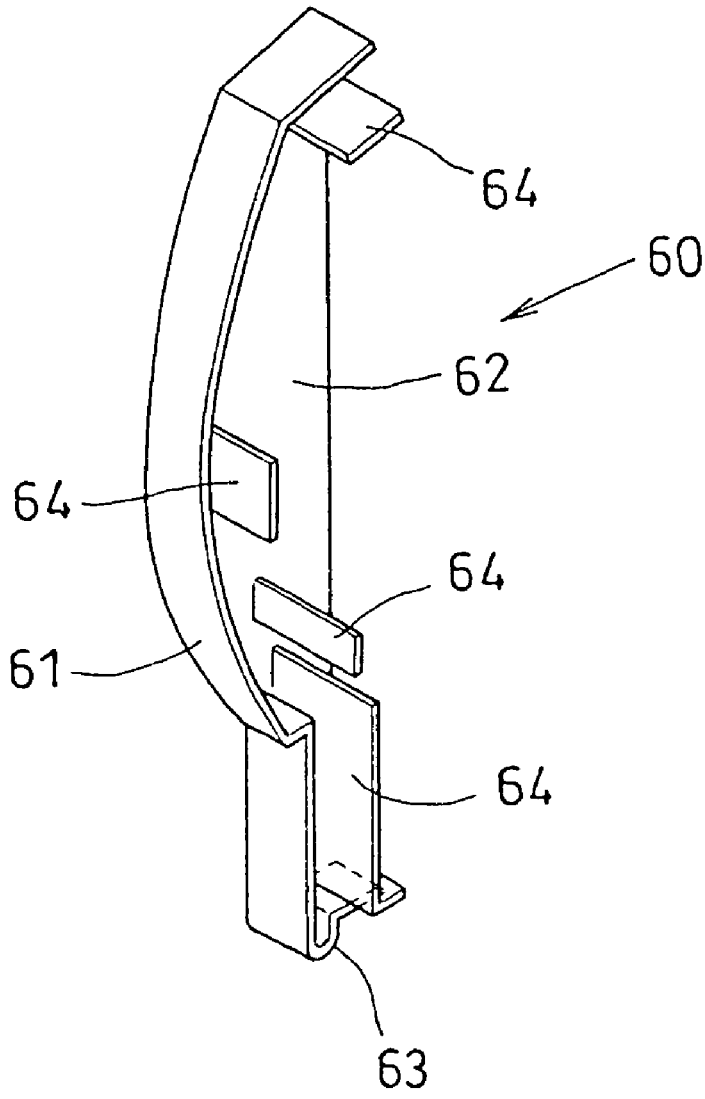
FIG. 8 is a perspective view showing an end cap preferably used in an embodiment of the present invention.

In the aforementioned construction structure, in some cases, the end face of the modesty panel 1 fixed to the external wall surface 2 is exposed as it is depending on the construction work. FIG. 8 shows an end cap 60 for hiding the end face of the modesty panel 1 in the aforementioned case. Like the aforementioned joint member 50, the end cap 60 is provided with a surface member 61 having a configuration to be fitted to the configuration of the surface side of the modesty panel main body 30 and an end face member 62 formed at the end face of the surface member 61. At the lower end of the surface member 61, a bottom plate 63 configured to cover the lower end of the modesty panel 1 is formed. The surface member 61 and the end face member 62 are provided with a plurality of insertion pieces 64 extending in the longitudinal direction of the modesty panel 1. These insertion pieces 64 are disposed on the rear surface of the base member 10 or the rear surface of the modesty panel main body 30, or inserted therebetween, to thereby detachably attach the end cap 60 to the end face of the modesty panel 1. The end cap 60 can be an aluminum member or a resin member, such as, e.g., an AES resin member.

Figure 9:
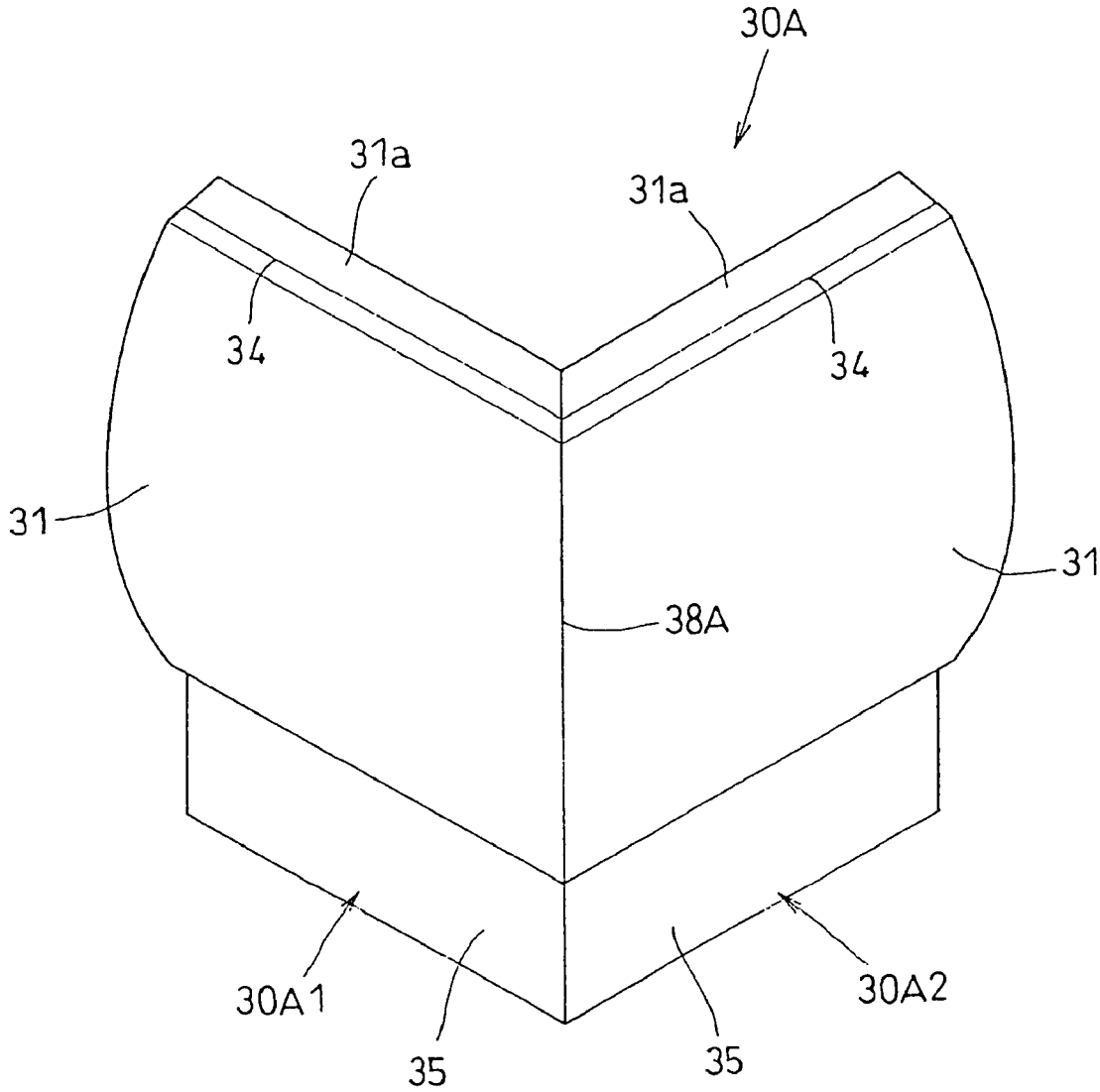
FIG. 9 is a perspective view showing a modesty panel main body external corner member to be used at an external corner portion in an external wall construction structure equipped with the modesty panel according to an embodiment of the present invention.
Figure 10:
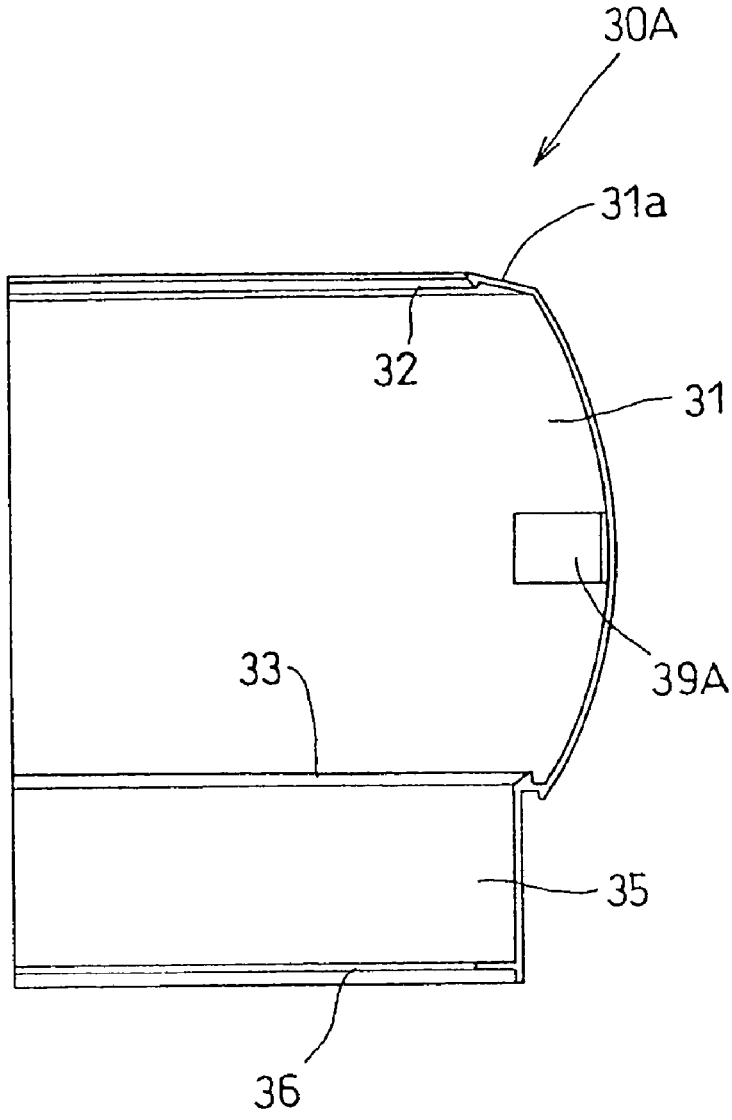
FIG. 10 is a side view showing the modesty panel main body external corner member shown in FIG. 9.

FIGS. 9 and 10 show a modesty panel main body external corner member 30A to be used at an external corner portion of an external wall construction structure equipped with the aforementioned modesty panel 1. FIG. 9 is a perspective view of the external corner member 30A as seen from the upper above, and FIG. 10 is a side view thereof. The modesty panel main body external corner member 30A is formed by cutting a member having the same side view configuration as the modesty panel main body 30 with a 45° cutting surface facing toward the rear surface side to obtain external corner member pieces 30A1 and 30A2 and then joining the two external corner member pieces 30A1 and 30A2 with adhesive from the rear surface side to form an angle of 90° therebetween. In FIGS. 9 and 10, the same reference numeral as the modesty panel main body 30 is allotted to the corresponding portion of each external corner member piece 30A1 and 30A2. In FIG. 10, the reference numeral "39A" denotes a reinforcing member for reinforcing the joint portion of two external corner member pieces 30A1 and 30A2. Although not illustrated, this modesty panel main body external corner member 30A is fixed to the base member 10 fixed near the external corner portion in the same manner as in the aforementioned modesty panel main body 30 to form an external corner portion of the modesty panel 1.

Figure 11:
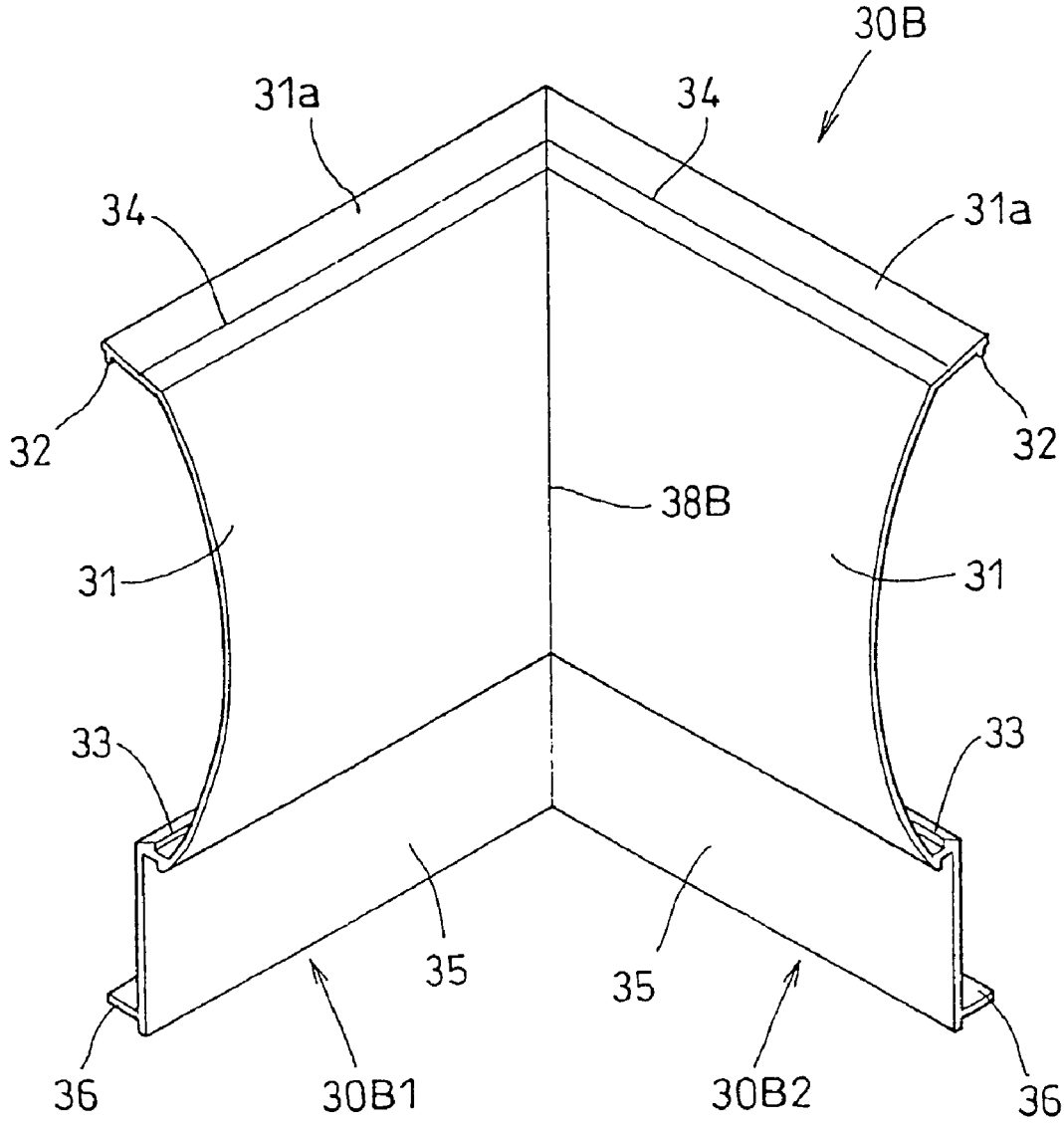
FIG. 11 is a perspective view showing a modesty panel main body internal corner member to be used at an internal corner portion in an external wall construction structure equipped with the modesty panel according to an embodiment of the present invention.
Figure 12:
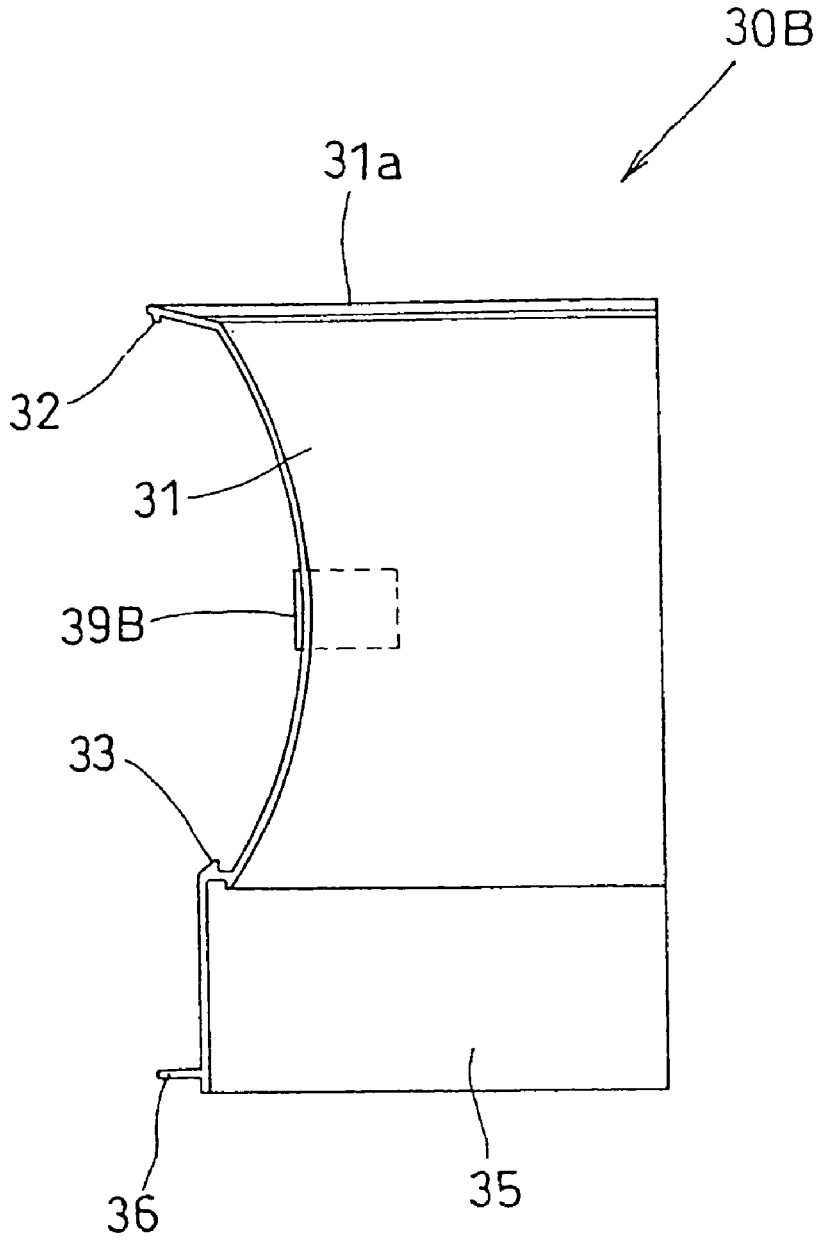
FIG. 12 is a side view showing the modesty panel main body internal corner member shown in FIG. 11.

FIGS. 11 and 12 show a modesty panel main body internal corner member 30B to be used at an internal corner portion of an external wall construction structure equipped with the aforementioned modesty panel 1. FIG. 11 is a perspective view of the internal corner member 30B as seen from the upper above, and FIG. 12 is a side view thereof.

In the same manner as in the modesty panel main body external corner member 30A, the modesty panel main body internal corner member 30B is formed by cutting a member having the same side view configuration as the modesty panel main body 30 with a 45° cutting surface facing toward the front side to obtain internal corner member pieces 30B1 and 30B2 and then joining the two internal corner member pieces 30B1 and 30B2 with adhesive from the rear surface side to form an angle of 90° therebetween. In FIGS. 11 and 12 too, the same reference numeral as the modesty panel main body 30 is allotted to the same portion of each internal corner member piece 30B1 and 30B2. In FIG. 12, the reference numeral "39B" denotes a reinforcing member for reinforcing the joint portion of two internal corner member pieces 30B1 and 30B2. Although not illustrated, this modesty panel main body internal corner member 30B is fixed to the base member 10 fixed near the internal corner portion in the same manner as in the aforementioned modesty panel main body 30 to form an internal corner portion of the modesty panel 1.

Figure 13:
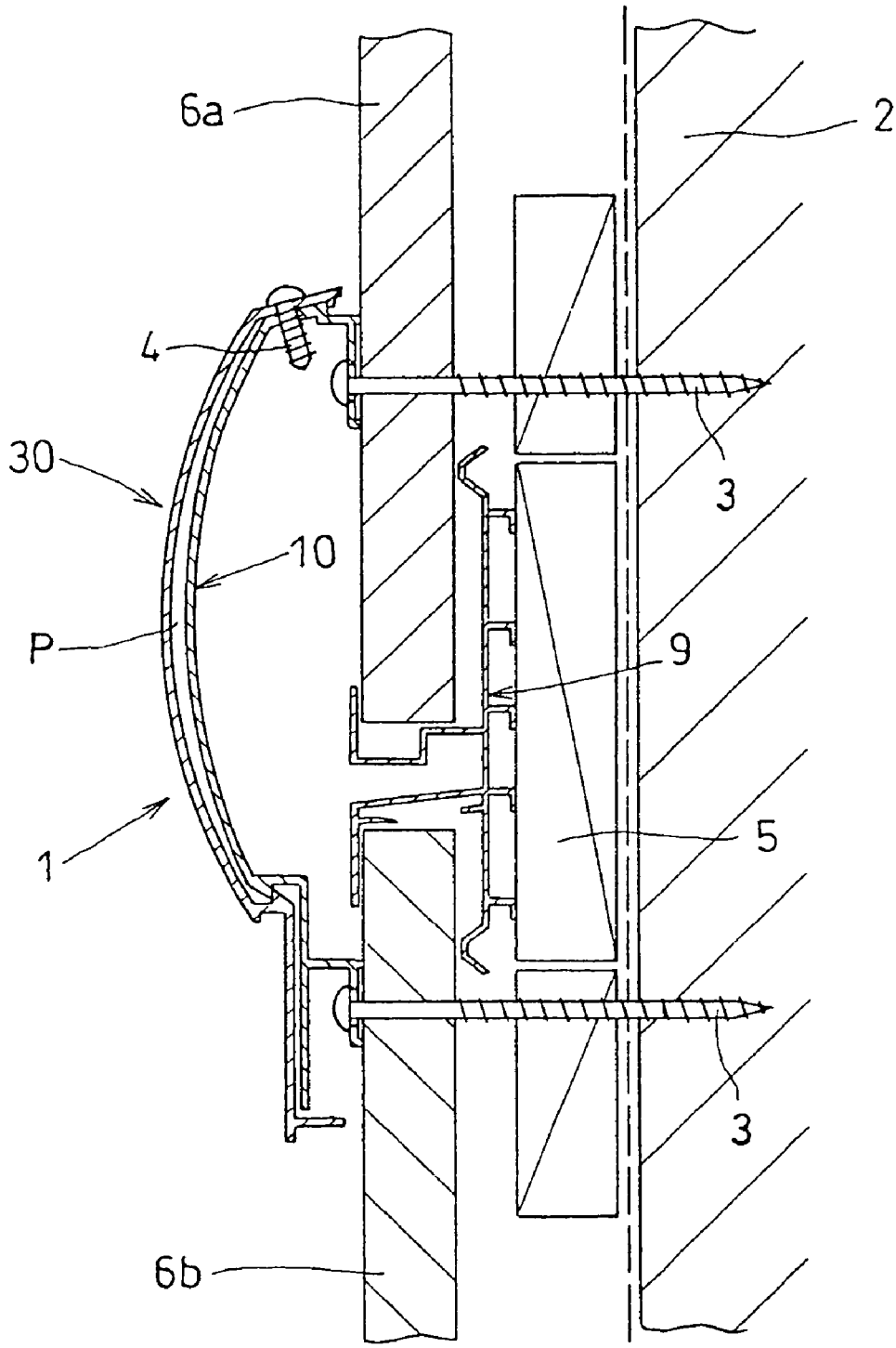
FIG. 13 is a cross-sectional view showing another example of an external wall construction structure after fixing the modesty panel.
Figure 14:
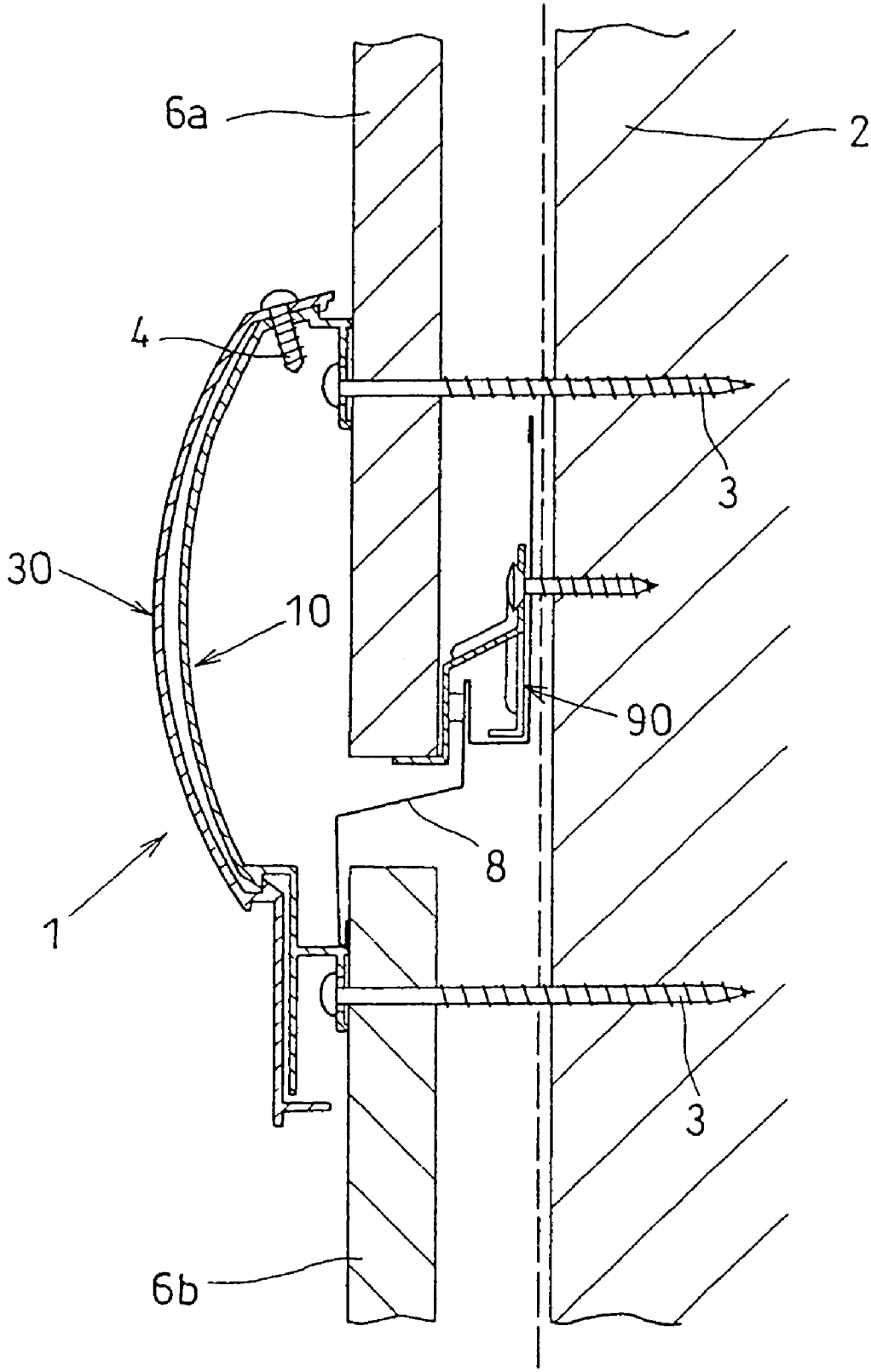
FIG. 14 is a cross-sectional view showing yet another example of an external wall construction structure after fixing the modesty panel.
Figure 15:
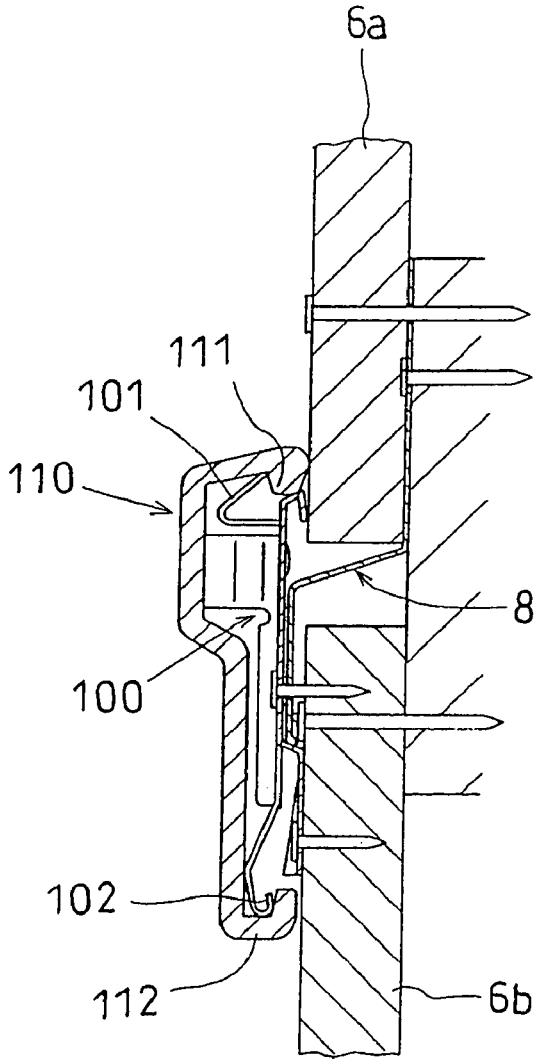
FIG. 15 is a cross-sectional view for explaining an attaching structure of a fiber reinforced cement siding type modesty panel.
Figure 16:
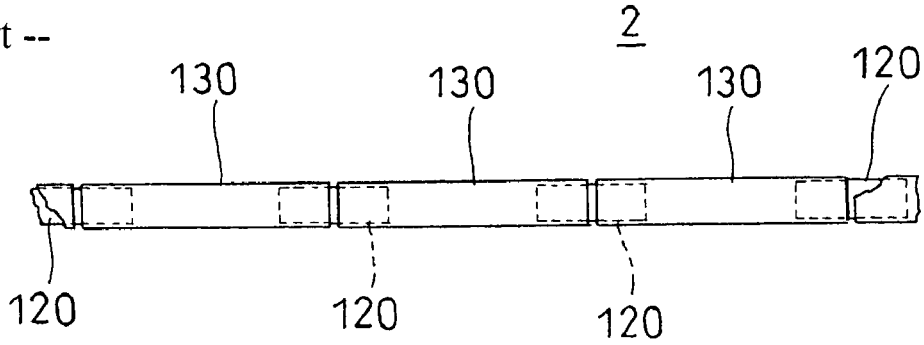
FIG. 16 is a front view showing an attaching structure of a resin modesty panel.
Figure 17:
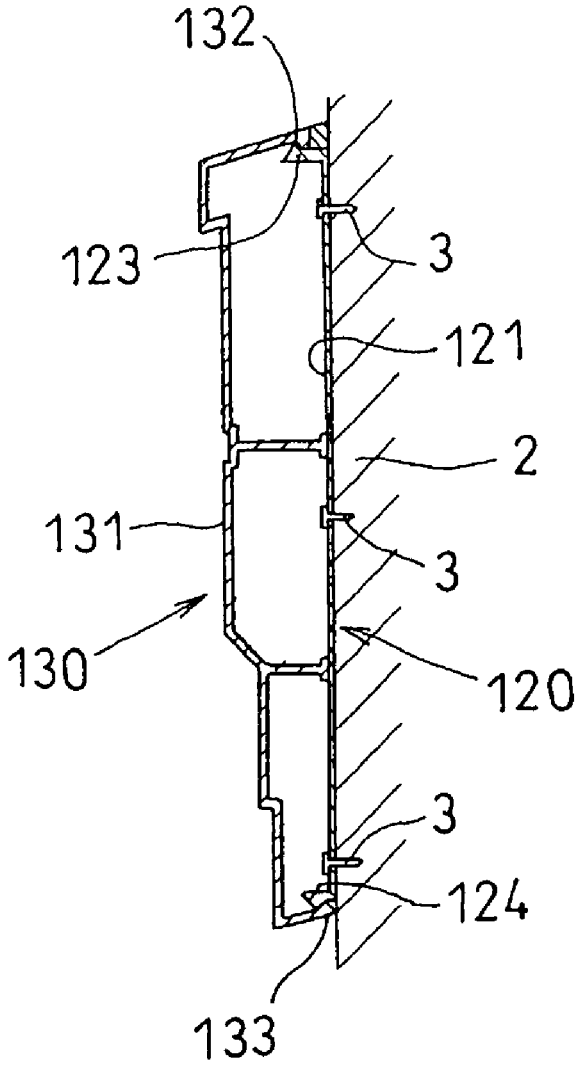
FIG. 17 is a cross-sectional view showing an attaching structure of the resin modesty panel.

FIGS. 13 and 14 each show a cross-sectional view showing an external wall construction structure according to another embodiment of the present invention, and each corresponds to FIG. 6. In the embodiment shown in FIG. 13, an upper-panel-and-lower-panel connecting member 9 for connecting the upper and lower external wall panels 6*a* and 6*b* is used. In the embodiment shown in FIG. 14, both a starter member 90 and a water draining member 8 are used. In each case, as mentioned above, it can be understood from the drawings that a space is formed between the upper attaching portion 12 of the base member 10 and the lower attaching portion 13 thereof, and therefore the fixing of the base member 10 can be performed under no influence of the upper-panel-and-lower-panel connecting member 9, the starter member 90 and/or the water draining member 8. In FIGS. 13 and 14, the same reference numeral as the member shown in FIG. 6 is allotted to a corresponding portion/member having the same effect, and the explanation will be omitted. The upper-panel-and-lower-panel connecting member 9 can be a conventionally known member, and the explanation will be omitted.

While the present invention may be embodied in many different forms, a number of illustrative embodiments are described herein with the understanding that the present disclosure is to be considered as providing examples of the principles of the invention and such examples are not intended to limit the invention to preferred embodiments described herein and/or illustrated herein.

While illustrative embodiments of the invention have been described herein, the present invention is not limited to the various preferred embodiments described herein, but includes any and all embodiments having equivalent elements, modifications, omissions, combinations (e.g., of aspects across various embodiments), adaptations and/or alterations as would be appreciated by those in the art based on the present disclosure. The limitations in the claims are to be interpreted broadly based on the language employed in the claims and not limited to examples described in the present specification or during the prosecution of the application, which examples are to be construed as non-exclusive. For example, in the present disclosure, the term "preferably" is non-exclusive and means "preferably, but not limited to." In this disclosure and during the prosecution of this application, means-plus-function or step-plus-function limitations will only be employed where for a specific claim limitation all of the following conditions are present in that limitation: a) "means for" or "step for" is expressly recited; b) a corresponding function is expressly recited; and c) structure, material or acts that support that structure are not recited. In this disclosure and during the prosecution of this application, the terminology "present invention" or "invention" is meant as a non-specfic, general reference and may be used as a reference to one or more aspect aspects within the present disclosure. The language "present invention" or "invention" should not be improperly interpreted as an identification of criticality, should not be improperly interpreted as applying across all aspects or embodiments (i.e., it should be understood that the present invention has a number of aspects and embodiments), and should not be improperly interpreted as limiting the scope of the application or claims. In this disclosure and during the prosecution of this application, the terminology "embodiment" can be used to describe any aspect, feature, process or step, any combination thereof, and/or any portion thereof, etc. In some examples, various embodiments may include overlapping features. In this disclosure and during the prosecution of this case, the following abbreviated terminology may be employed: "e.g." which means "for example;" and "NB" which means "note well."

What is claimed is:

1. A modesty panel, comprising:

a base member to be attached to an external wall portion, and a modesty panel main body to be attached to the external wall portion via the base member, wherein the base member is integrally provided with a surface portion, an upper attaching portion extending along an upper edge of the surface portion, and a lower attaching portion extending along a lower edge of the surface portion, the base member being brought into contact with the external wall portion only at the upper and lower attaching portions, wherein a first engaging stepped portion and a second engaging stepped portion are formed in a vicinity of the upper attaching portion of the base member and a vicinity of the lower attaching portion of the base member, respectively, the first engaging stepped portion and the second engaging stepped portion being arranged in parallel with each other, wherein the modesty panel main body is provided with a surface portion, a first engaging ridge integrally formed in a vicinity of an upper edge of the surface portion so as to be engaged with the first engaging stepped portion of the base member, a second engaging ridge integrally formed in a vicinity of a lower edge of the surface portion so as to be engaged with the second engaging stepped portion of the base member, the first engaging ridge and the second engaging ridge being arranged in parallel with each other, wherein, in a state in which the first and second engaging ridges of the modesty panel main body are outwardly engaged with the first and second engaging stepped portions of the base member, respectively, the vicinity of the upper edge of the surface portion of the modesty panel main body and the vicinity of the upper edge of the surface portion of the base member form a superimposed region configured to fix the modesty panel main body and the base member with a fixing screw, and wherein the base member is provided with a first opening formed in a region facing to the upper attaching portion of the base member and a second opening formed in a region facing to the lower attaching portion of the base member, each of the openings being defined as a tool insertion hole to be used when the base member is attached to the external wall portion with screws.

2. The modesty panel as recited claim 1, wherein the upper attaching portion of the base member is integrally provided with a protruded ridge or protrusion having a tip serving as a contacting portion to be brought into contact with an external wall surface, and wherein the lower attaching portion of the base member is integrally provided with a protruded ridge or protrusion having a tip serving as a contacting portion to be brought into contact with an external wall surface.

3. The modesty panel as recited in claim 1, wherein the vicinity of the upper edge of the surface portion of the base member to be superimposed by the vicinity of the upper edge of the surface portion of the modesty panel main body is inclined forwardly obliquely downward, and wherein the vicinity of the upper edge of the surface portion of the modesty panel main body to be superimposed by the vicinity of the upper edge of the surface portion of the base member is inclined forwardly obliquely downward.

4. The modesty panel as recited in claim 1, wherein the base member has a vertical plate formed at a position lower than the second engaging stepped portion, and wherein the modesty panel main body has a vertical plate formed at a position lower than the second engaging ridge so as to face to the vertical plate of the base member when the modesty panel main body is integrally combined with the base member and an inwardly extended horizontal plate formed at a lower end of the vertical plate of the modesty panel main body so as to extend over the vertical plate of the base member when the modesty panel main body is integrally combined with the base member.

5. The modesty panel as recited in claim 1, wherein the surface portion of the modesty panel main body is formed into a curved surface as seen from its side.

6. The modesty panel as recited in claim 5, wherein the surface portion of the base member is formed into a curved surface as seen from its side so that a clearance is formed between the surface portion of the modesty panel main body and the surface portion of the base member when the modesty panel main body is integrally combined with the base member.

7. The modesty panel as recited in claim 1, wherein each of the modesty panel main body and the base member is an aluminum integrally molded article.

8. An external wall construction structure using the modesty panel as recited in claim 1, wherein external wall panels are fixed to a building external wall surface, wherein the base member is fixed to the external wall panels with screws in a state in which rear ends of the upper attaching portion and the lower attaching portion are brought into contact with the external wall panels, wherein the modesty panel main body is fixed to the base member in a state in which the first engaging ridge of the modesty panel main body and the second engaging ridge thereof are outwardly engaged with the first engaging stepped portion of the base member and the second engaging stepped portion thereof, respectively, and wherein the superimposed region formed by the vicinity of the upper edge of the surface portion of the base member and the vicinity of the upper edge of the surface portion of the modesty panel main body is fixed with a screw.

9. The external wall construction structure as recited in claim 8, wherein the screw used to fix the base member to the external wall panel is screwed through the external wall panel and a furring strip.

10. The external wall construction structure as recited in claim 8, wherein an upper external wall panel and a lower external wall panel are fixed to the building external wall surface in an adjacently arranged manner, and wherein the upper attaching portion of the base member and the lower attaching portion thereof are fixed to a lower end portion of the upper external wall panel and an upper end portion of the lower external wall panel, respectively.

* * * * *